US006237459B1

(12) United States Patent
Brown

(10) Patent No.: US 6,237,459 B1
(45) Date of Patent: May 29, 2001

(54) CORNER MAKING TOOL

(75) Inventor: Charles Brown, Cornelius, OR (US)

(73) Assignee: Duramax, Inc., Middlefield, OH (US)

( * ) Notice: Subject to any disclaimer, the term of this patent is extended or adjusted under 35 U.S.C. 154(b) by 0 days.

(21) Appl. No.: 09/400,805

(22) Filed: Sep. 22, 1999

(51) Int. Cl.[7] ..... B27G 5/02

(52) U.S. Cl. ..... 83/762; 83/454; 83/465; 83/581

(58) Field of Search ..... 83/762, 761, 454, 83/465, 581, 455, 821, 820; 269/290, 295, 87.5

(56) References Cited

U.S. PATENT DOCUMENTS

| | | | | |
|---|---|---|---|---|
| 1,718,791 | | 6/1929 | Ludwig . | |
| 2,085,321 | * | 6/1937 | Lang | 269/87.2 |
| 2,518,801 | | 8/1950 | Ludwig . | |
| 3,782,235 | | 1/1974 | Curcio . | |
| 3,837,253 | | 9/1974 | Slemmons . | |
| 4,218,947 | | 8/1980 | Laviola . | |
| 4,281,827 | * | 8/1981 | Horwarth | 269/295 |
| 4,436,014 | | 3/1984 | O'Neill . | |
| 4,550,636 | * | 11/1985 | Josselson et al. | 269/87.2 |
| 4,807,505 | * | 2/1989 | Campbell et al. | 83/454 |
| 5,287,784 | * | 2/1994 | Brockett | 83/762 |
| 5,522,296 | | 6/1996 | Stoller . | |
| 5,813,306 | * | 9/1998 | Jacoff | 83/762 |
| 5,907,989 | * | 6/1999 | Sie et al. | 83/762 |
| 5,927,701 | * | 7/1999 | Chapman | 269/87.2 |

* cited by examiner

*Primary Examiner*—Rinaldi I. Rada
*Assistant Examiner*—Omar Flores-Sánchez
(74) *Attorney, Agent, or Firm*—D. Peter Hochberg; Katherine R. Vieyra; William H. Holt

(57) ABSTRACT

A cove base cutting guide tool for guiding a knife through the guide tool and making a mitered cut on a cove base material. The guide tool includes a base and a plurality of tower members extending vertically from the base forming a first and second guide wall. The first and second guide walls define a groove having the same general shape as the cove base material to be cut. The groove includes a generally straight portion extending from a top to a bottom of the first and second guide walls with an open end at the top of the guide walls. The groove is wider at the bottom of the straight portion than the top of the straight portion. The first and second guide walls flex away from one another at the top of the groove when receiving the cove base material, and apply friction to the cove base material at the top of the cove base material when the cove base material is inserted into the groove. One or more slits are provided and extend through the guide walls along a predetermined angle and run transversely to the groove.

11 Claims, 3 Drawing Sheets

CORNER MAKING TOOL

BACKGROUND OF THE INVENTION

1. Field of the Invention

The present invention relates generally to wall base molding and flooring tools, and more particularly to an improved cove base cutting guide tool for making mitered cuts in rubber or plastic wall or cove base material, so that the sections can be glued together to form a sharp 90° corner.

2. Description of the Prior Art

The present cove base cutting guide tools have a variety of problems associated with the use of these tools in real world applications. For example, U.S. Pat. No. 5,522,296 discloses a cove base cutting guide in the form of a block. The patent discusses the problems associated with prior art guide devices for use with cove bases made of a softer material, such as a rubber or synthetic rubber, because the material is not held into place firmly during cutting resulting in an imperfect cut. The patent further discusses the problems associated with bending the cove base around the corners, such that the cove bases do not match the sharp contour of the corner and provide an imperfect aesthetically unpleasing look. The patent then discusses solving these problems by providing a block with an entry port that is J-shaped for receiving cove base material, and an exit port on the opposite end for removing the base material. The two ports define a J-shaped chamber that extends from one end of the block to the opposite end, and is sized to provide friction on the base material when it is enclosed in the chamber. The patent states that the friction is applied, so that the base material can be stabilized in the chamber during cutting, so that the cuts are not distorted. Slits are provided in the front of the block for cutting the base material at 90°, or plus or minus 45°. The slits do not extend beyond the bottom of the block and are designed to receive a utility knife blade. The knife is inserted into the slit piercing the cove base material, and is then run down the length of the slit to make the mitered cut.

In real world applications, there are many problems associated with the device shown in U.S. Pat. No. 5,522,296. For example, this structure is rigid and can only be used with one thickness of cove base material (i.e. ⅛ inch). The device could not be used for a thinner or thicker base material, of which there are many available in the industry. Further, during use of the device, the J-hook portion of the slot faces the user and must be placed in a direction away from the wall. In practical applications, cove base material comes off of a roll that could be up to 120 feet in length, and the user would want to make the cut with the base lined up on the wall, rather than facing away from the wall during the mitered cut as the device shown in U.S. Pat. No. 5,522,296 must be used. The device provides a hollow chamber to enable the blade to enter the box and would require a stabilizing block to keep the box from leaning over as the knife blade is inserted into the tool. The use of a slit on the side of the box, provides for the blade on a knife to pierce the base rather than simply cutting it, which may cause stretching of the cove base material before it is pierced, thus resulting in inaccuracies in the cut of the cove base material. Since the device is inflexible, it can only apply friction to one size base. Therefore, when beginning at the top of the slit the cove base material of a smaller thickness is subject to movement causing irregularities in the cut of the cove base material. Also, because of the rigidity of the structure, when the appropriate width of cove base material is used through the chamber of the box, the friction is applied at the bottom of the box because of the angle of the cove base material. This results in more play at the top of the cove base material than at the bottom causing inaccurate cuts when a user begins the cut from the top of the cove base material. Finally, it is very important to be able to mark a cove base material along the top surface with a pencil, so that the user knows where to make the appropriate mitered cut. The block cove base cutter completely encloses the cove base material, and the user cannot see the pencil mark made on the top of the material when making the mitered cut.

U.S. Pat. No. 4,570,350 provides for a cove base corner cutter that includes two metal pieces held together with wing nuts, when the cove base material is inserted into the tool. The tool lays flat on the floor when it is being used and the cove base material is clamped into the device. The problem with this device is that it never stabilizes the cove base entirely, and the toe portion or wing portion would be deformed as pressure was applied by the wing nut, or the user applied hand pressure. The device is also extremely awkward to use, and again the base would face the wrong direction to lay against the wall after the cut, greatly increasing the time element involved in installing the cove base material. Further, the cove base is not easily placed in the tool, and the marks needed for the outside corner cuts cannot be seen once clamped into the device. Holding this tool down with one hand and cutting that close to the end, clearly would present safety issues and result in unacceptable risks of injury to the user.

SUMMARY OF THE INVENTION

In accordance with a preferred embodiment of the present invention, a cove base cutting tool is provided having a first and a second guide wall defining a groove therebetween. The groove has generally the same shape as the cove base material to be cut, and includes a generally straight portion extending from a top to a bottom of the first and second guide walls. The straight portion of the groove includes an open end at the top of the first and the second guide walls. The groove portion is wider at the bottom of the straight portion than the top of the straight portion. The cove base cutting tool includes one or more slits extending through the first wall and the second guide wall along a predetermined angle, and running transverse to the groove. According to a particular aspect of the invention, a cove base cutting guide is provided having a first and a second guide wall defining a groove therebetween. The groove has generally the same shape as the cove base material to be cut. The first and second guide walls are flexible at a top area of the groove, such that the first and second guide walls flex away from one another at the top area of the groove when receiving the cove base material, and then apply friction to the cove base material at a top area of the cove base material when the cove base material is inserted into the groove. The cove base cutting tool includes one or more slits extending through the first guide wall and the second guide wall along a predetermined angle, and running transverse to the groove. According to another particular aspect of the preferred embodiment, a cove base cutting tool is provided having a base and a plurality of tower members extending vertically from the base and forming a first wall portion and a plurality of tower members extending vertically from the base and forming a second wall portion. The first and second wall portion define a groove therebetween having the same general shape as the cove base material to be cut. The groove includes a generally straight portion extending from a top to a bottom of the first and second wall portion. The straight portion of the groove includes an open end at the top of the first and the second wall portions. The groove portion is wider at the bottom of the straight portion than the top of the straight portion, and the first and second wall portion flex away from one another at the top of the groove when receiving the cove base material. The first and second wall portions apply friction to the cove base material at the top of the cove base material when the cove base material is inserted into the groove. The cove base cutting guide tool includes one or more slits extending through the first wall portion and the second wall portion along a predetermined angle, and run transverse to the groove.

It is an object of this invention to provide a cutting guide tool for cutting mitered corners in cove base material.

It is another object of the invention to provide the above cutting guide tool that is shaped to receive cove base material including a wing or a foot portion.

It is yet another object of the invention to provide a cutting guide tool for cutting mitered corners in cove base material that accommodates cove base material of various thicknesses.

It is a further object of the invention to provide the above cutting guide tool that applies friction to the cove base material at the top of the cove base material. It is an object of the invention to provide a cutting guide tool for cutting mitered corners on cove base material that is stable, easy to use, and easy to manufacture, while still providing precise mitered cuts.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DESCRIPTION OF THE PREFERRED EMBODIMENT

Figure 1:
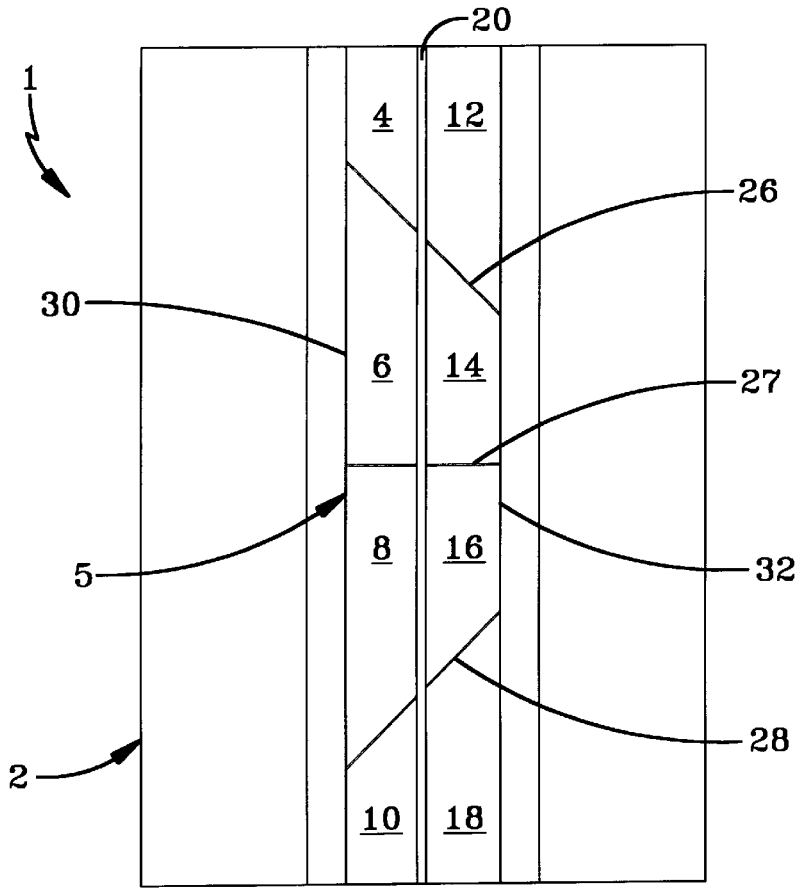
FIG. 1 is an end perspective view of the preferred tool.
Figure 2:
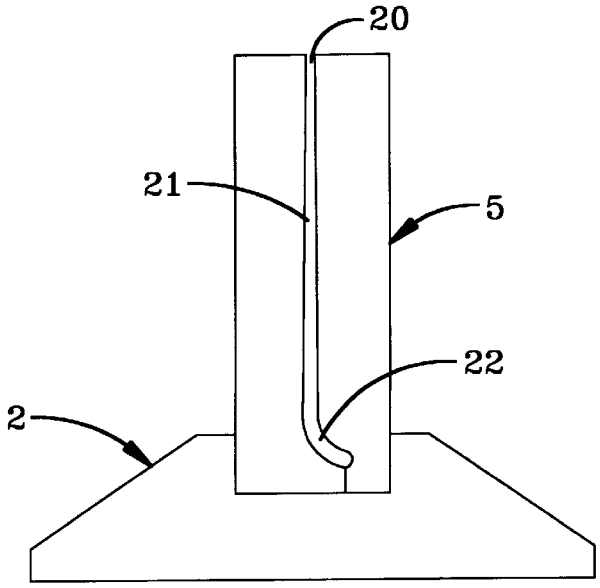
FIG. 2 is a side perspective view of the preferred tool.
Figure 3:
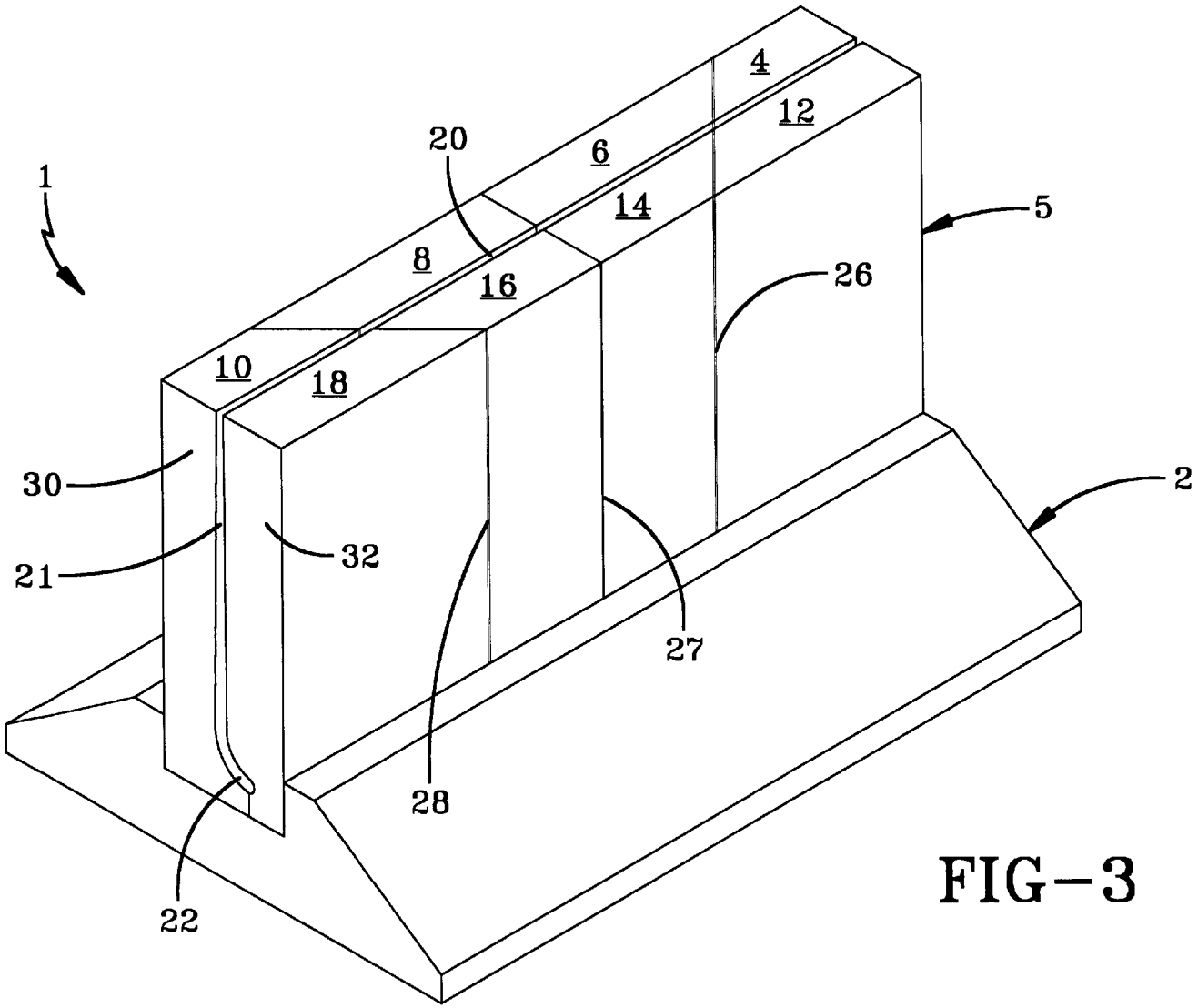
FIG. 3 is a perspective view of the preferred tool.

Referring now to the drawings provider for the purpose of the illustrating the preferred embodiment of the invention only, FIGS. 1–3 show a cove base tool 1 including a base portion 2 and a guide portion 5. Guide portion 5 is essentially formed of eight tower portions 4, 6, 8, 10, 12, 14, 16 and 18. Tower portions 4, 6, 8 and 10 form a first guide wall 30 and tower portions 12, 14, 16 and 18 form a second guide wall 32. Guide walls 30 and 32 define a groove 20 therebetween. Groove 20 includes a generally straight portion 21 having and open end, and a foot or wing portion 22 extending from its opposite end, so that the groove has a generally J or hook-like overall shape for receiving cove base material having essentially the same or a similar general shape. Importantly, generally straight portion 21 is chamfered such that the top of the groove near the open end widens as it approaches the bottom of the groove near the foot or wing portion 22. This allows for receiving cove base material of various thicknesses because the top of guide walls 30 and 32 can flex outwardly, expanding groove 20 at its top end to allow it to receive cove base material of different thicknesses, while the bottom portion of groove 20 near foot or wing portion 22 is dimensioned wider than the top portion for accommodating the thicker types of cove base material. During insertion of the cove base material, the cove base material can be slid into the side of groove 20 causing the top portion of the guide walls 30 and 32 to flex outwardly, until the cove base material is completely inserted into the guide. Guide walls 30 and 32 are inwardly biased and apply friction to the top of the cove base material when the cove base material is at rest in the guide. This ensures that the cove base material will be held sternly at the top of the cove base material where the precise cut will begin, regardless of the width of the cove base material.

Figure 4:
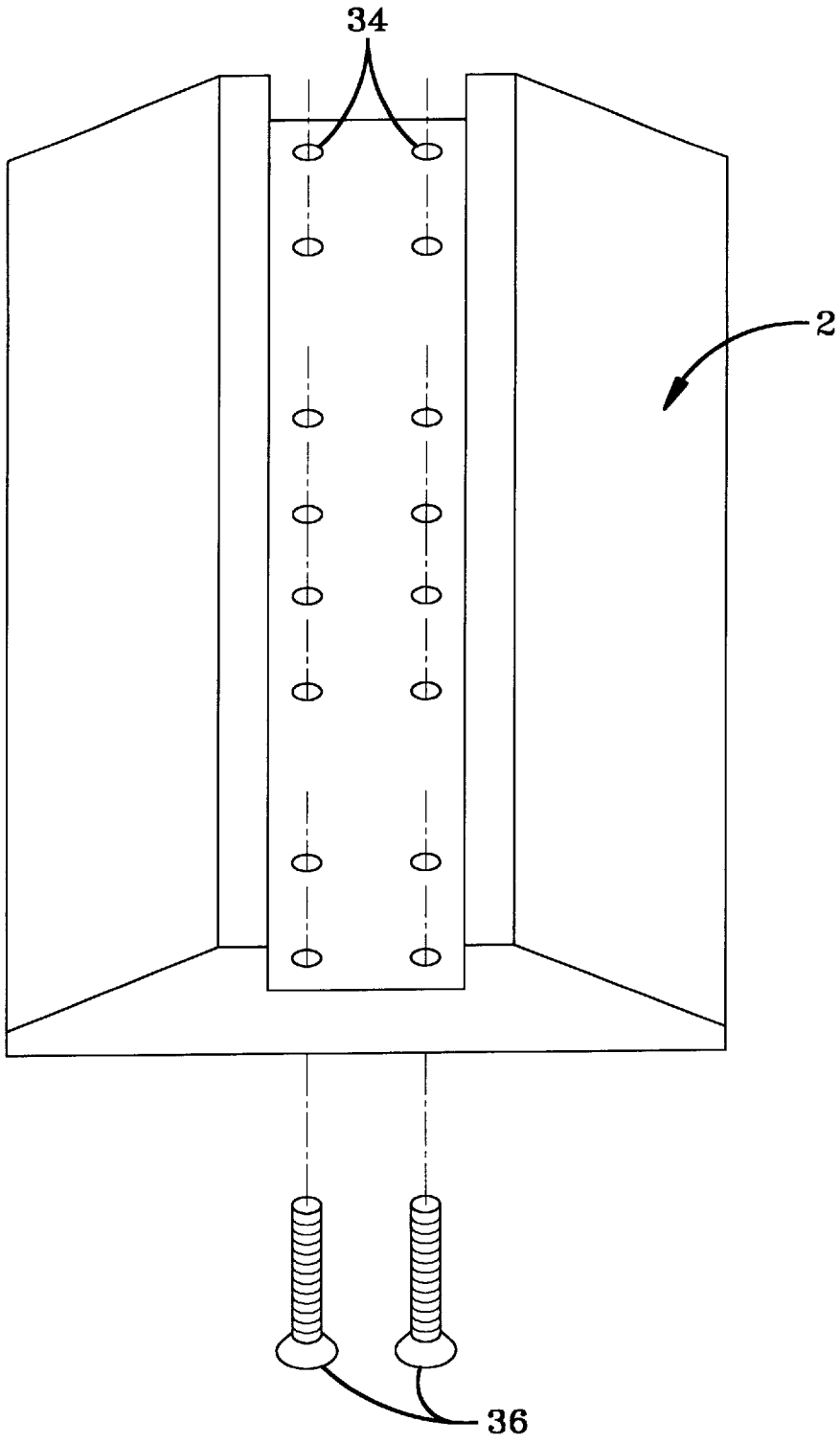
FIG. 4 is an exploded view of the base portion and a pair of screws of the preferred tool.

Base portion 2 includes a plurality of apertures 34 for receiving a plurality of fasteners therethrough as shown in FIG. 4. Each tower is affixed to base 2 by a pair of screws 36 received through aperture 34 and screwed into each one of the towers to hold the towers in place on base 2. The towers not only define groove 20, but also define slots 26 and 28 at 45° and 135° cutting angles, respectively, and a slot 27 at a 90° cutting angle. Each slot extends from wall portion 32 through wall portion 30, so that the slot extends across entire guide portion 5. This allows the user to practically use any type of blade for cutting the cove base material. Preferably, the slots have a width of 0.026 inches. In the preferred embodiment, the height of the tower will exceed the height of the cove base material, so that the slots 26, 27 and 28 act as guides for guiding the knife to the top of the cove base material to begin the cutting process. For example, if using a cove base material having a height of four inches, a five inch height for the tower portions is preferred. Further, the user can look down through the open end of groove 20 to the top of the cove base material to see any markings necessary for aligning the marking up with one of the slots. Optionally, spacers may be provided at the bottom of each slot for stabilization purposes.

Cove base tool 1 can be placed against a wall, so that the cove base material to be cut faces its eventual installed direction. The cove base material is then slid through groove 20 causing guide walls 30 and 32 to flex outwardly, and open up to receive the cove base material. Once the cove base material is inserted into groove 20, the top portions of guide walls 30 and 32 flex back inwardly and apply friction to the top of the cove base material. The cove base material can be easily adjusted to align any markings essential for making the appropriate cut of the cove base material. The user can then place the knife over the guide portion 5 down through one of the slots 26, 27, or 28, which guide the knife to the top of the cove base material to begin the mitered cut. The knife is then run through the cove base material until reaching the bottom of the slots and making a precise mitered cut. Since friction is applied to the top of the cove base material, the cut is made accurately because the initial cutting of the material is where the most force is necessary to begin the cutting process. After the cove base material has been appropriately cut, it can be glued together to form a 90° corner. Typically, the cove base material is inserted into guide 1, and a cut is made along slot 26 and another cut is made along slot 28, forming two corners that can be glued to one another. The material is then pulled out from each end and a small amount of glue is placed along the edge of each piece and the two corners are pressed to one another. Once the glue dries, a perfect corner is formed and the cove base material may then be applied to the bottom base of the wall.

The foregoing description is a specific embodiment of the present invention. It should be appreciated that this embodiment is described for the purposes of illustration only, and that numerous alterations and modifications may be practiced by those skilled in the art without departing from the spirit and scope of the invention. It is intended that all such modifications or alterations be included insofar as they come within the scope of the invention as claimed or equivalence thereof.

What is claimed is:

1. A cove base cutting guide tool for guiding a knife through the guide tool and making a mitered cut on a cove base material, said guide tool comprising:

a base;

a plurality of tower members extending vertically from said base and forming a first wall portion and a plurality of tower members extending vertically from said base and forming a second wall portion, said first and said second wall portions defining a groove therebetween, said groove having the same general shape as the cove base material to be cut, said groove having a generally straight portion extending from a top to a bottom of said first and said second wall portions, said straight portion having an open end at the top of said first and said second wall portions, wherein said groove is wider at the bottom of said straight portion than the top of said straight portion, said first and said second wall portions flexing away from one another at the top of said groove when receiving the cove base material and applying friction to the cove base material at the top of the cove base material when the cove base material is inserted into said groove; and one or more slits extending through said first wall portion and said second wall portion along a predetermined angle, said one or more slits running transversely to said groove.

2. The claim as defined in claim 1, wherein said first and said second wall portions both have a height greater than the cove base material to be cut.

3. The claim as defined in claim 1, wherein said groove includes a foot portion extending from the bottom of said straight portion.

4. A cove base cutting guide tool for guiding a knife through the guide tool and making a mitered cut on a cove base material received in said guide tool, said guide tool comprising:

a first and a second guide wall defining a groove, said groove having the same general shape as the cove base material to be cut, said groove having a generally straight portion extending from the top to the bottom of said first and said second guide wall and having an open end at the top of said first and said second guide wall wherein said groove is wider at the bottom of the straight portion than at the top of the straight portion;

at least one slit extending through said first guide wall and said second guide wall along a predetermined angle, said at least one slit running transversely to said groove; and wherein said first and said second guide walls each are comprised of a plurality of tower members, said tower members defining said groove and said at least one slit.

5. The guide tool as defined in claim 4, and further including a base extending transversely to said first and said second guide wall for supporting said guide tool.

6. The guide tool as defined in claim 4, wherein said first and said second guide walls both have a height greater than the height of the cove base material to be cut.

7. The guide tool as defined in claim 4, wherein said groove includes a foot portion extending from the bottom of said straight portion for receiving the bottom portion of the cove base material.

8. A cove base cutting guide tool for guiding a knife through the guide tool and making a mitered cut on a cove base material received in said guide tool, said guide tool comprising:

a first and a second guide wall defining a groove having the same general shape as the cove base material to be cut, both of said first and said second guide walls being flexible at a top area of said groove, said first and second guide walls each flexing away from one another at the top area of said groove in response to both receiving the cove base material and the application of friction to the cove base material at the top area of the cove base material when the cove base material is inserted into said groove; and at least one slit extending through said first guide wall and said second guide wall along a predetermined angle, said at least one slit running transversely to said groove; and wherein said first and said second guide walls are both comprised of a plurality of tower members, said tower members defining said groove and said at least one slit.

9. The claim as defined in claim 8, and further including a base extending transversely to said first and said second guide walls for supporting said guide tool.

10. The claim as defined in claim 8, wherein said first and said second guide walls each have a height greater than the height of the cove base material to be cut.

11. The claim as defined in claim 8, wherein said groove includes a foot portion extending from the bottom of said straight portion for receiving the bottom portion of the cove base material.

* * * * *